US008963664B2

(12) United States Patent
Dede et al.

(10) Patent No.: US 8,963,664 B2
(45) Date of Patent: Feb. 24, 2015

(54) MAGNETIC FIELD MANIPULATION DEVICES

(71) Applicant: Toyota Motor Engineering & Manufacturing North America, Inc., Erlanger, KY (US)

(72) Inventors: Ercan Mehmet Dede, Ann Arbor, MI (US); Debasish Banerjee, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 3 days.

(21) Appl. No.: 14/038,986

(22) Filed: Sep. 27, 2013

(65) Prior Publication Data

US 2014/0028425 A1 Jan. 30, 2014

Related U.S. Application Data

(63) Continuation of application No. 13/492,087, filed on Jun. 8, 2012, now Pat. No. 8,570,128.

(51) Int. Cl.

| | |
|---|---|
| ***H01F 7/00*** | (2006.01) |
| ***H01F 5/00*** | (2006.01) |
| ***H01F 7/10*** | (2006.01) |
| ***H01F 7/12*** | (2006.01) |

(52) U.S. Cl.

CPC .. *H01F 5/00* (2013.01); *H01F 7/10* (2013.01); *H01F 7/1205* (2013.01)

USPC ..... 335/229; 335/236

(58) Field of Classification Search

USPC ..... 335/299

See application file for complete search history.

(56) References Cited

U.S. PATENT DOCUMENTS

| | | | |
|---|---|---|---|
| 1,161,819 | A | 11/1915 | Grob |
| 1,768,907 | A | 7/1930 | Heinkel |
| 1,817,763 | A | 8/1931 | Purington |
| 1,834,431 | A | 12/1931 | Smith |
| 2,540,022 | A | 1/1951 | Rabenda |
| 2,859,298 | A | 11/1958 | Burch |

(Continued)

OTHER PUBLICATIONS

Lee, J., et al., "Topology optimization of switched reluctance motors for the desired torque profile," Struc Multidisc Optim, 42:783-796 (2010).

(Continued)

*Primary Examiner* — Shawki S Ismail
*Assistant Examiner* — Lisa Homza
(74) *Attorney, Agent, or Firm* — Dinsmore & Shohl LLP

(57) ABSTRACT

Magnetic field manipulation devices and magnetic actuators are disclosed. In one embodiment, a magnetic field manipulation device includes an iron base substrate having a surface, and at least four electrically conductive loops embedded in the surface of the iron substrate. The at least four electrically conductive loops are electrically coupled to one another, and are arranged in the surface of the iron substrate such that the magnetic field manipulation device diverges magnetic flux lines of a magnetic field generated by a magnetic field source positioned proximate the magnetic field manipulation device. In another embodiment, the at least four electrically conductive loops are electrically isolated such that the magnetic field manipulation device converges magnetic flux lines of a magnetic field generated by a magnetic field source positioned proximate the magnetic field manipulation device.

12 Claims, 8 Drawing Sheets

(56) References Cited

U.S. PATENT DOCUMENTS

| | | | | |
|---|---|---|---|---|
| 3,281,739 | A | 10/1966 | Grengg | |
| 3,772,540 | A | 11/1973 | Benson | |
| 3,987,646 | A | 10/1976 | Knourek et al. | |
| 4,010,390 | A | 3/1977 | Stempfli | |
| 4,216,454 | A | 8/1980 | Ohtani et al. | |
| 4,327,345 | A | 4/1982 | Kelso et al. | |
| 4,381,490 | A | 4/1983 | Peters | |
| 4,642,501 | A | 2/1987 | Kral et al. | |
| 4,651,118 | A | 3/1987 | Zeuner et al. | |
| 4,658,231 | A | 4/1987 | Schwenzer et al. | |
| 4,698,537 | A | 10/1987 | Byrne et al. | |
| 4,700,097 | A | 10/1987 | Kawada et al. | |
| 4,751,415 | A | 6/1988 | Kitamori et al. | |
| 4,849,666 | A | 7/1989 | Hoag | |
| 4,918,831 | A | 4/1990 | Kliman | |
| 4,967,464 | A | 11/1990 | Stephens | |
| 5,138,291 | A | 8/1992 | Day | |
| 5,220,228 | A | 6/1993 | Sibata | |
| 5,239,277 | A | 8/1993 | Vielot | |
| 5,428,257 | A | 6/1995 | Lurkens | |
| 5,608,369 | A | 3/1997 | Irgens et al. | |
| 5,668,430 | A | 9/1997 | Kolomeitsev | |
| 5,747,912 | A | 5/1998 | Sakuma et al. | |
| 5,781,090 | A | 7/1998 | Goloff et al. | |
| 5,844,346 | A | 12/1998 | Kolomeitsev et al. | |
| 5,852,335 | A | 12/1998 | Suzuki et al. | |
| 5,886,605 | A | 3/1999 | Ulerich et al. | |
| 5,890,662 | A | 4/1999 | Dykstra | |
| 5,945,761 | A | 8/1999 | Sakuma | |
| 5,955,934 | A | 9/1999 | Raj | |
| 5,969,589 | A | 10/1999 | Raj | |
| 6,002,233 | A | 12/1999 | McCann | |
| 6,066,904 | A | 5/2000 | Fei et al. | |
| 6,072,260 | A | 6/2000 | Randall | |
| 6,087,752 | A | 7/2000 | Kim et al. | |
| 6,093,993 | A | 7/2000 | McClelland | |
| 6,232,693 | B1 | 5/2001 | Gierer et al. | |
| 6,249,198 | B1 | 6/2001 | Clark et al. | |
| 6,501,359 | B2 | 12/2002 | Matsusaka et al. | |
| 6,624,538 | B2 | 9/2003 | Janisiewicz et al. | |
| 6,657,348 | B2 | 12/2003 | Qin et al. | |
| 6,720,686 | B1 | 4/2004 | Horst | |
| 6,731,191 | B2 | 5/2004 | Lang et al. | |
| 6,816,048 | B2 | 11/2004 | Morita et al. | |
| 6,859,114 | B2 | 2/2005 | Eleftheriades et al. | |
| 6,867,525 | B2 | 3/2005 | Ionel et al. | |
| 6,960,862 | B2 | 11/2005 | Hill | |
| 6,967,424 | B2 | 11/2005 | Popov | |
| 7,014,168 | B2 | 3/2006 | Shimura et al. | |
| 7,034,427 | B2 | 4/2006 | Hirzel | |
| 7,116,030 | B2 | 10/2006 | Torok | |
| 7,182,051 | B2 | 2/2007 | Sedda et al. | |
| 7,205,685 | B2 | 4/2007 | Reichert et al. | |
| 7,350,763 | B2 | 4/2008 | Hofling | |
| 7,420,308 | B2 | 9/2008 | Ramu et al. | |
| 7,511,597 | B2 | 3/2009 | Sata et al. | |
| 7,560,835 | B2 | 7/2009 | Groening et al. | |
| 7,661,653 | B2 | 2/2010 | Kondoh | |
| 7,710,225 | B2 | 5/2010 | Uni | |
| 7,786,641 | B2 | 8/2010 | Nishijima | |
| 7,982,567 | B2 | 7/2011 | Cartier Millon et al. | |
| 8,003,965 | B2 | 8/2011 | Grbic et al. | |
| 8,013,316 | B2 | 9/2011 | Eleftheriades | |
| 8,013,698 | B2 | 9/2011 | Bonjean et al. | |
| 8,451,080 | B2 * | 5/2013 | Lee et al. | 335/281 |
| 8,576,036 | B2 * | 11/2013 | Fullerton et al. | 335/306 |
| 2002/0057153 | A1 | 5/2002 | Matsusaka et al. | |
| 2004/0155545 | A1 | 8/2004 | Kaplan et al. | |
| 2006/0086396 | A1 | 4/2006 | Ando | |
| 2006/0272714 | A1 | 12/2006 | Carrillo et al. | |
| 2007/0152790 | A1 | 7/2007 | Telep | |
| 2007/0267922 | A1 | 11/2007 | Uni | |
| 2008/0276889 | A1 | 11/2008 | Sfaxi et al. | |
| 2009/0021334 | A1 | 1/2009 | Okada | |
| 2009/0065615 | A1 | 3/2009 | Mizui et al. | |
| 2009/0167119 | A1 | 7/2009 | Nakayama et al. | |
| 2009/0230333 | A1 | 9/2009 | Eleftheriades | |
| 2009/0237014 | A1 | 9/2009 | Yamada | |
| 2009/0303154 | A1 | 12/2009 | Grbic et al. | |
| 2010/0008009 | A1 | 1/2010 | Cartier-Millon et al. | |
| 2010/0052455 | A1 | 3/2010 | Feng et al. | |
| 2010/0148598 | A1 | 6/2010 | Kim et al. | |
| 2010/0231433 | A1 | 9/2010 | Tishin et al. | |
| 2010/0264770 | A1 | 10/2010 | Braun et al. | |
| 2010/0282223 | A1 | 11/2010 | Czimmek et al. | |
| 2012/0206001 | A1 | 8/2012 | Lee et al. | |
| 2012/0206226 | A1 * | 8/2012 | Lee et al. | 335/229 |
| 2013/0003245 | A1 | 1/2013 | Banerjee | |
| 2013/0038147 | A1 | 2/2013 | Dede | |

OTHER PUBLICATIONS

Mote, R.G. et al., "Near-field focusing properties of zone plates in visible regime—New insight," Optics Express, 16 (13): 9554-9564, 2008.

Li, J. et al., "The influence of propagating and evanescent waves on the focusing properties of zone plate structures," Optics Express, 17(21): 18462-18468, 2009.

M.F. Imani, A. Grbic, Near-Field Focusing with a Corrugated Surface, IEEE Antennas and Wireless Propagation Letters, vol. 8, 2009.

A. Grbic, L. Jiang, R. Merlin, Near-Field Plates: Subdiffraction Focusing with Patterned Surfaces, Science, vol. 320, 2008.

A. Grbic, R. Merlin, Near-Field Focusing Plates and their Design, IEEE Transactions on Antennas and Propagation, vol. 56, 2008.

* cited by examiner

MAGNETIC FIELD MANIPULATION DEVICES

CROSS REFERENCE TO RELATED APPLICATIONS

This application is a continuation of U.S. patent application Ser. No. 13/492,087 filed Jun. 8, 2012 and titled "Magnetic Field Manipulation Devices and Actuators Incorporating the Same," the entire disclosure of which is incorporated by reference.

TECHNICAL FIELD

The present specification generally relates to magnetic devices and, more particularly, to magnetic devices for manipulating magnetic fields, as well as to magnetic actuators.

BACKGROUND

A magnetic actuator generally includes a magnet, which may be a permanent magnet or an electromagnet, and a plunger. When an electromagnet is energized, a magnetic force acts on the plunger. For example, the plunger may be drawn toward the electromagnet. Magnetic actuators have a variety of applications. Accordingly, improvements in actuators, such as improved methods of increasing the magnetic force, may be desirable. Electromagnetic interference generated by components (e.g., switching power supplies, integrated circuits, and other magnetic field generating devices) may interfere with the proper operation of electrical components that are in close proximity to the electromagnetic interference. Accordingly, improvements in electromagnetic shielding of electrical components may also be desirable.

SUMMARY

In one embodiment, a magnetic field manipulation device includes an iron base substrate having a surface, and at least four electrically conductive loops embedded in the surface of the iron substrate. The at least four electrically conductive loops are electrically coupled to one another, and are arranged in the surface of the iron substrate such that the magnetic field manipulation device diverges magnetic flux lines of a magnetic field generated by a magnetic field source positioned proximate the magnetic field manipulation device.

In another embodiment, a magnetic field manipulation device includes an iron substrate assembly having an array of segments. Each segment has an iron substrate with a surface, and an electrically conductive loop embedded in the surface. Individual segments of the array of segments are coupled together by a dielectric bonding agent such that the electrically conductive loop of each segment is electrically isolated from electrically conductive loops of adjacent segments in the array of segments. The electrically conductive loops are arranged in the iron substrate assembly such that the magnetic field manipulation device converges magnetic flux lines of a magnetic field generated by a magnetic field source positioned proximate the magnetic field manipulation device.

In yet another embodiment, an actuator includes a magnet body having a magnet end portion, a magnetic field manipulation device coupled to the magnet end portion, and a plunger. The magnetic field manipulation device includes an iron substrate assembly having a surface, and at least four electrically conductive loops embedded in the surface of the iron substrate assembly. The plunger includes a plunger end portion, wherein the plunger is moveable relative to the magnet end portion, and a gap is present between the magnet end portion and the plunger end portion. The magnet body produces a magnetic force on the plunger induced by magnetic flux extending through the gap between the magnet end portion and the plunger end portion. The magnetic field manipulation device alters the magnetic force at the plunger end portion.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments of the present disclosure are directed to magnetic field manipulation devices configured to manipulate magnetic flux distributions of a magnetic field source for either focusing or shielding applications. In magnetic field focusing applications, such as actuator applications, the magnetic field may be manipulated by a magnetic field manipulation device (i.e., near field plate) such that the magnetic flux of the magnetic field source, such as an electromagnet or a permanent magnet, for example, is focused toward a surface of an actuated portion, such as a plunger. Such focused magnetic flux upon the actuated portion may increase the magnetic force acting upon the actuated portion in comparison to a non-focused magnetic flux distribution. In magnetic shielding applications, such as electromagnetic interference (EMI) shielding applications, for example, the magnetic field manipulation device may be configured to defocus the magnetic flux generated by the magnetic field generating device to avoid particular components that are near the magnetic field generating device. As an example and not a limitation, a magnetic field manipulation device may be located proximate to an inverter circuit to shield EMI-sensitive devices away from magnetic flux that is generated by the inverter circuit. Various embodiments of magnetic field manipulation devices and actuators incorporating the same are described in detail below with reference to the figures.

Figure 1:
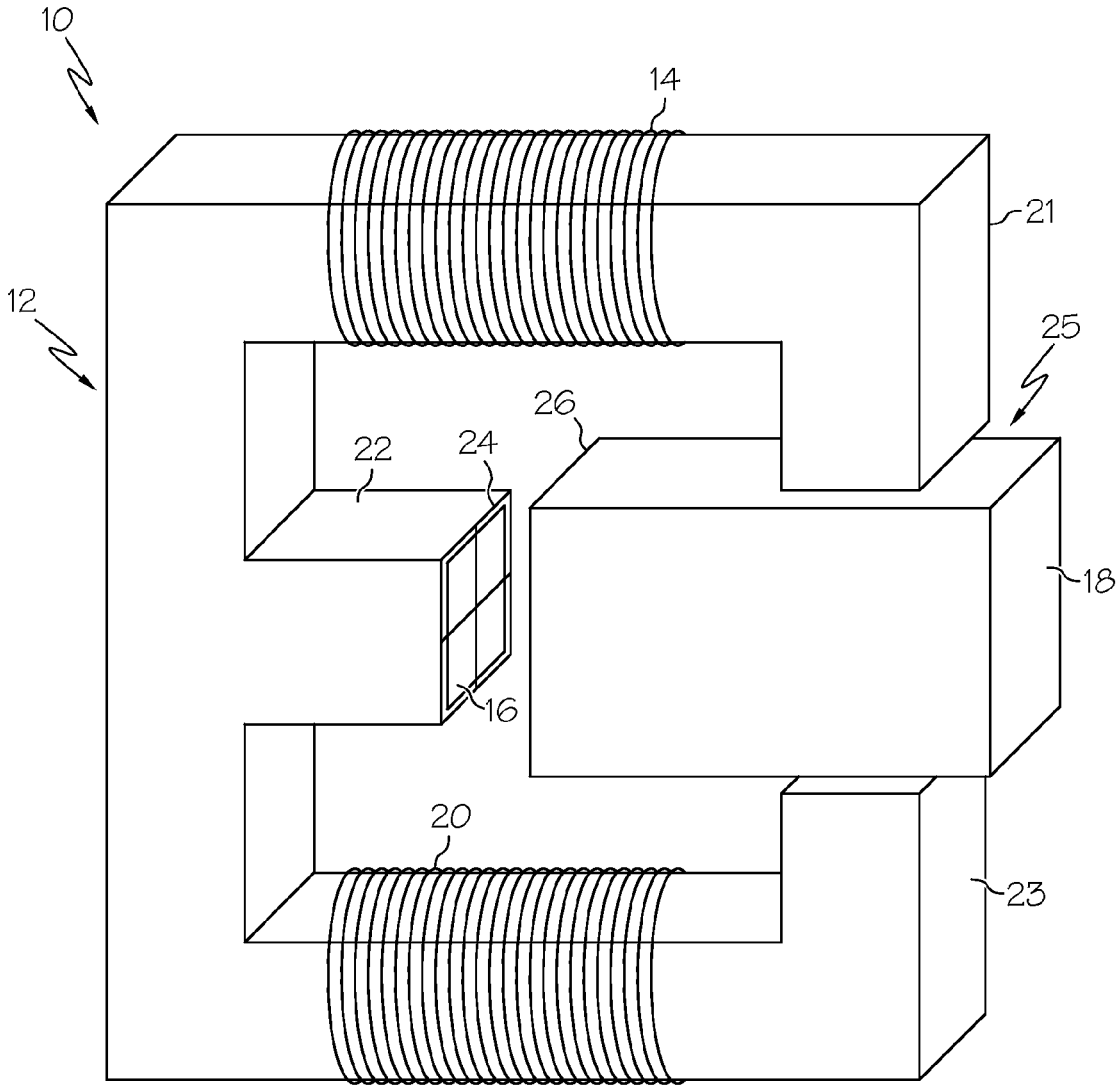
FIG. 1 schematically depicts an exemplary magnetic actuator having a magnetic field manipulation device and a plunger according to one or more embodiments shown and described herein.

Referring initially to FIG. 1, an exemplary magnetic actuator 10 incorporating a magnetic field manipulation device in the form of a near field plate 16 is schematically illustrated. It should be understood that embodiments are not limited to the configuration of the exemplary magnetic actuator 10 depicted in FIG. 1, and that many other actuator configurations are also possible. The magnetic actuator 10 is configured as an electromagnet including one or more coils, such as a first coil 14 and a second coil 20, supported by a magnet body 12. The illustrated magnet body 12 comprises a first arm 21, a second arm 23, and a central protruding portion 22 having a tip 24. The electromagnet may produce a magnetic field when alternating current is passed through the first and second coils. The near field plate 16 is positioned at the tip 24 of the protruding portion 22 such that it manipulates the magnetic field produced by the electromagnet, as described below.

The magnetic actuator 10 further comprises an actuated portion configured as a moveable plunger 18 that is offset from the near field plate 16 by a gap and positioned in an opening 25 between first and second arms 21, 23. In one embodiment, the plunger 18 is disposed between the first and second arms 21, 23 via an air bearing. Other low friction arrangements may also be utilized to support the plunger.

When the first and second coils 14, 20 are energized, magnetic flux extends between the tip 24 of the magnet body and an end portion 26 of the plunger 18. A magnetic force is generated on the plunger 18 when the coils are energized, and magnetic flux crosses the air gap between the electromagnet and the plunger 18, which in this exemplary arrangement, pulls the plunger 18 toward the protruding portion 22 of the electromagnet. The plunger 18 is moveable relative to the protruding portion 22 of the electromagnet, and may be part of a plunger assembly including a bias spring for returning the plunger 18 to a starting position when the coils are de-energized.

As described in detail below, the near field plate 16 may be designed to either focus or defocus the magnetic flux generated by the electromagnet (or other magnetic field generating device, such as a permanent magnet or a magnetic field generating circuit). The near field plate 16 may be a patterned, grating-like plate having sub-wavelength features. More particularly, the near field plate 16 may comprise patterned conducting elements (e.g., wires, loops, corrugated sheets, capacitive elements, inductive elements, and/or other conducting elements) arranged on a dielectric substrate. The near field plate may be generally planar, or in other examples, may be curved to conform to a surface. Near field plates may focus electromagnetic radiation to spots or lines of arbitrarily small sub-wavelength dimensions. The near field plates described herein are configured to achieve focusing or shielding of low frequency (e.g., kHz) electromagnetic signals used in electromagnetic devices, such as actuators, and other devices, such as switching power supplies.

In the focusing embodiments, the magnetic flux lines converge toward one another at a particular location or locations away from the electromagnet. In shielding embodiments, the magnetic flux lines diverge away from one another at a particular location or locations away from the electromagnet. Embodiments providing magnetic field focusing will be described initially, followed by embodiments providing magnetic field shielding.

Figure 2A:
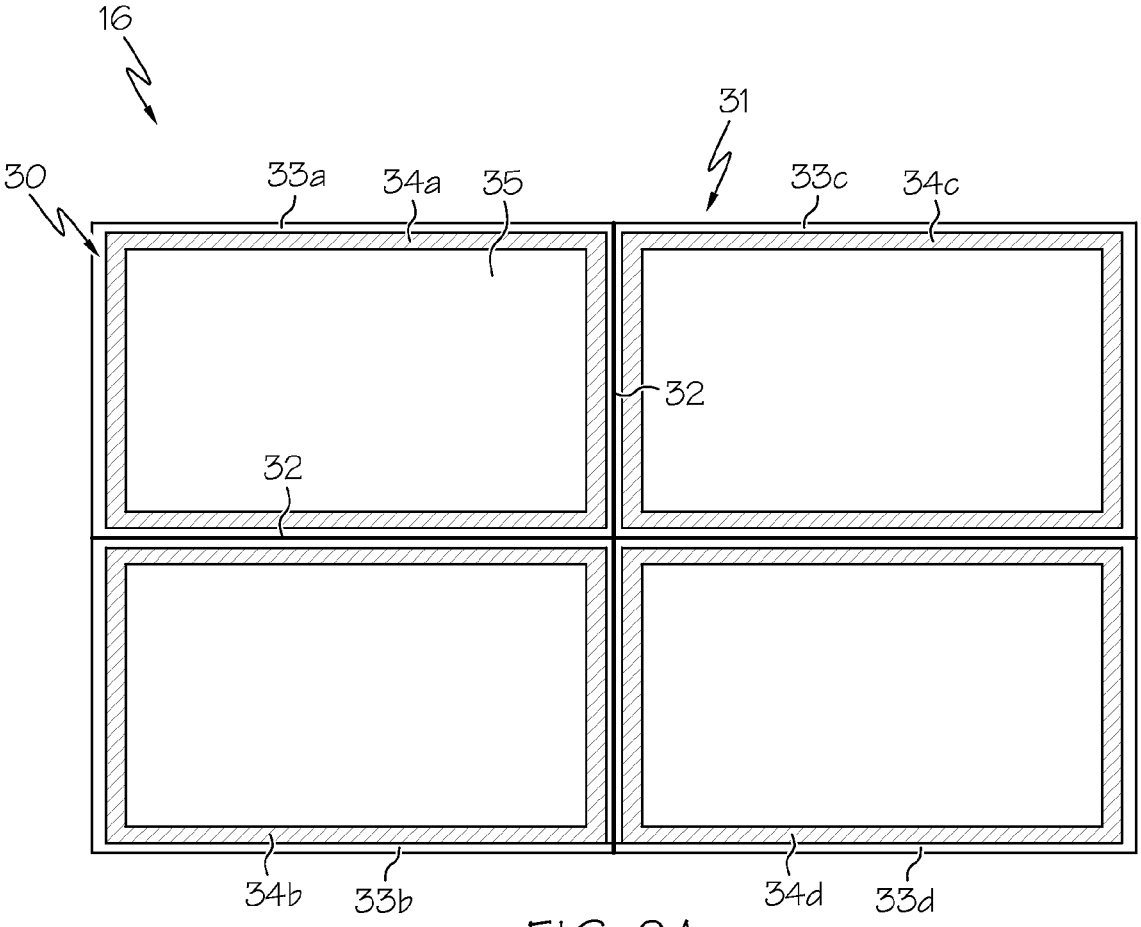
FIG. 2A schematically depicts a front view of an exemplary near field plate for magnetic field focusing according to one or more embodiments shown and described herein.
Figure 2B:
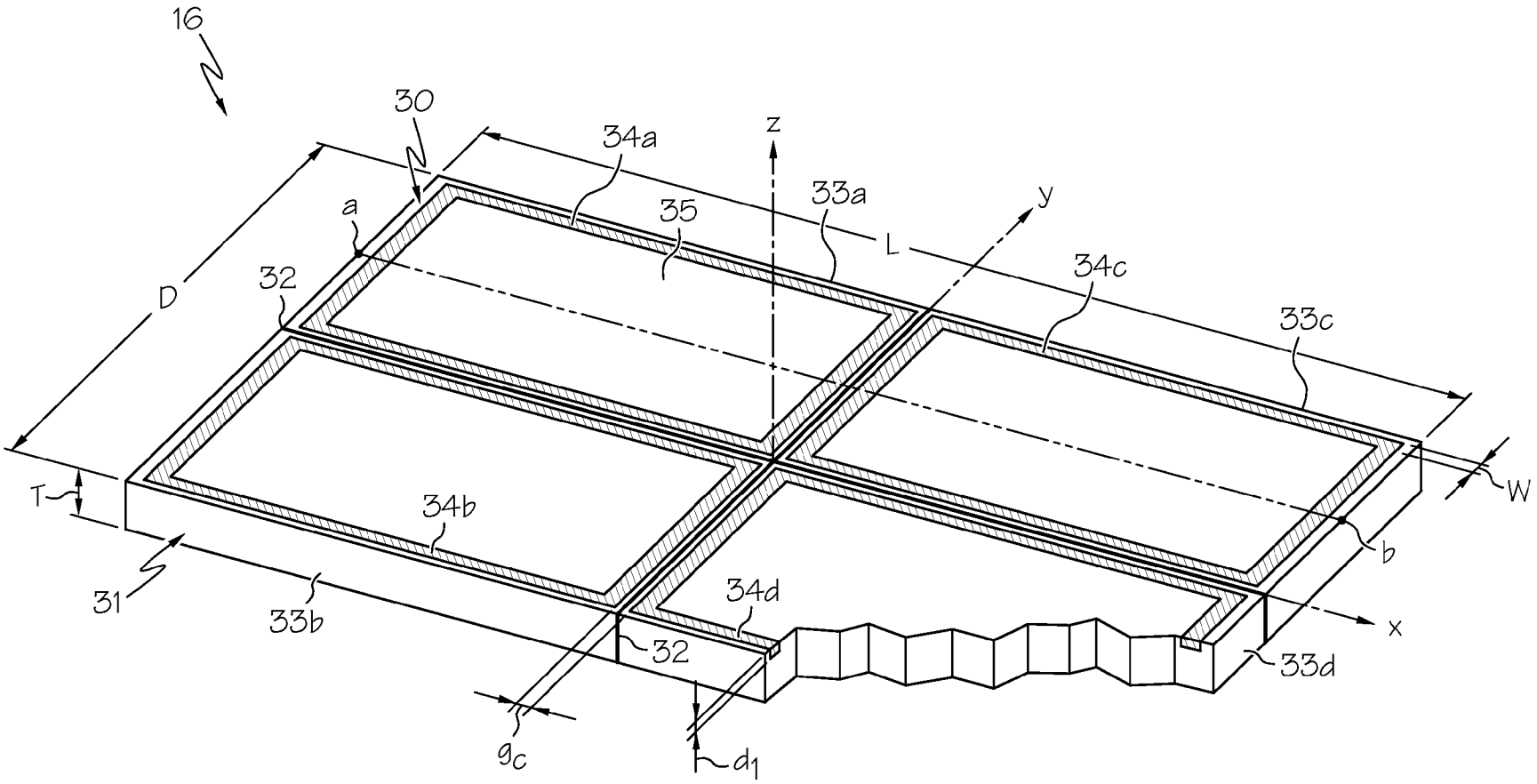
FIG. 2B schematically depicts a perspective, partial cutaway view of the exemplary near field plate depicted in FIG. 2A.

Referring now to FIGS. 2A and 2B, an exemplary near field plate 16 is illustrated. The near field plates described herein are capable of focusing (and defocusing, as described below) a kilohertz magnetic field and enhancing the associated magnetic force. Embodiments of the near field plates described herein are configured as an array of electrically conductive metallic loops that are embedded in a base substrate. Analytical calculations and numerical simulations verify that the induced electrical current in the loop structure influences the magnetic field distribution, thus leading to magnetic force enhancement. As described below, experimental measurements of the magnetic force generated by the device operating at 1 kHz are compared with measurements of a control sample without loops. Such devices have applications in electromechanical actuators and transducers.

The exemplary near field plate 16 depicted in FIGS. 2A and 2B include a 2×2 array of electrically conductive loops 34*a*-34*d* embedded in a surface 35 of a base substrate assembly 31. It should be understood that arrays of electrically conductive loops greater than 2×2 are also possible. The number of electrically conductive loops may depend on the particular application in which the near field plate 16 is employed.

FIG. 2A is a front view of a near field plate 16, while FIG. 2B is a perspective, partial cutaway view of the near field plate 16 depicted in FIG. 2A. The near field plate 16 comprises a 2×2 array of metallic loops of high electric conductivity (e.g., Cu) embedded in a base substrate assembly 31 of low electric conductivity (e.g., Fe). The base substrate assembly 31 is made up of an array of segments 30, with each segment having a base substrate 33*a*-33*d* with an electrically conductive loop. The individual segments are separated by a dielectric gap 32 such that the electrically conductive loops 34*a*-34*d* are electrically isolated with respect to one another.

As an example and not a limitation, near field plates 16 depicted in FIGS. 2A and 2B were fabricated for evaluation purposes as follows. First, four 0.8 mm wide (w) loop cavities spaced in a 2×2 array with gaps of 0.6 mm were micromachined to form grooves at a depth of 0.6 mm into a 50 mm×30 mm×2.5 mm (L×D×T) metallic ductile cast iron base substrate. It should be understood that dimensions of the exemplary near field plates are for illustrative purposes only, and that embodiments are not limited by any particular dimensions. The loop cavities formed rectangular grooves within the surface of the base substrate. Next, an electrodeposition technique was used to provide copper material into the fabricated loop cavity grooves. The deposited copper surface and the surrounding iron material were then ground flat such the resulting depth $d_l$ of the electrically conductive loops 34*a*-34*d* was 0.5 mm. Finally, the finished planar device was cut along its two centerlines and reassembled using a dielectric barrier epoxy bonding technique to achieve a final array gap spacing $g_c$ of approximately 1 mm provided by the dielectric gap 32, thus electrically isolating each electrically conductive loop 34*a*-34*d*.

Figure 3:
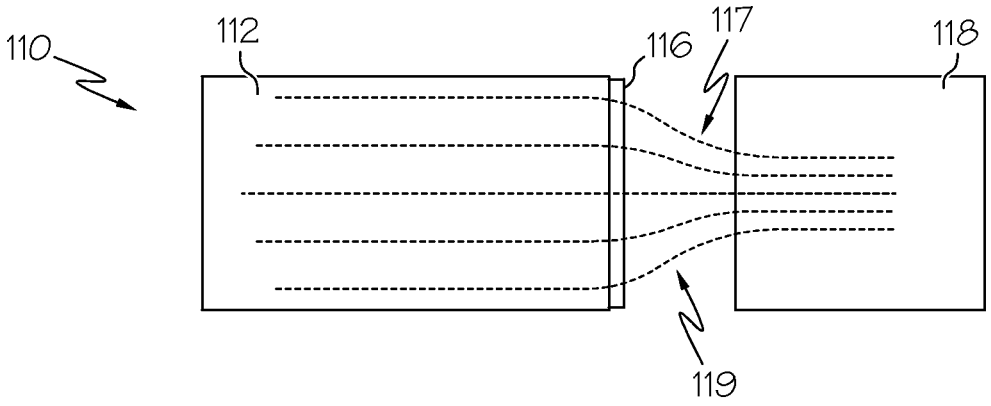
FIG. 3 schematically depicts an exemplary magnetic actuator having a near field plate providing a focused magnetic field according to one or more embodiments shown and described herein.

Referring now to FIG. 3, a simplified electromagnetic actuator 110 is schematically illustrated. The electromagnet actuator 110 has a magnet body 112, a near field plate 116, and a plunger 118. The near field plate 116 is coupled to an end face of the magnet body, as described above. The near field plate 116 may be configured as the near field plate 16 illustrated in FIGS. 2A and 2B, for example. The magnet body 112, which may be configured as an electromagnet having a coil (not shown in FIG. 3), produces a magnetic flux as depicted by dotted magnetic flux lines 117.

The near field plate 116 focuses the magnetic lines of flux 117 from the magnet body 112 so that they are concentrated within a central portion of the plunger 118. In other words, the magnetic lines of flux 117 converge at the plunger 118. Focusing of the magnetic field occurs through an air gap 119 between the near field plate 116 and the plunger 118. Without the near field plate 116, the magnetic flux lines would diverge away from one another after passing through the magnet body 112.

Figure 4:
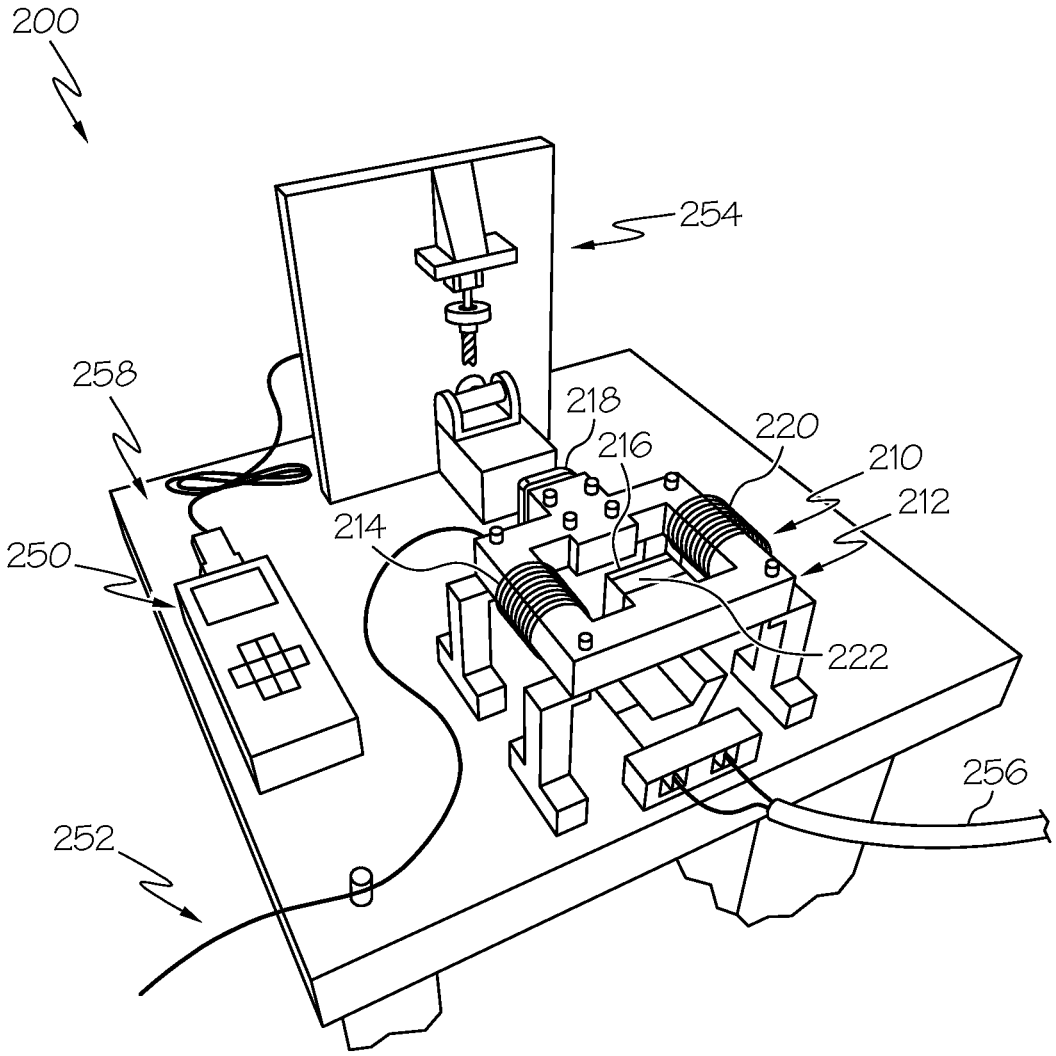
FIG. 4 schematically depicts an experimental test apparatus configured to evaluate an effect of near field plates on a magnetic actuator.

Referring to FIG. 4, an experimental test apparatus 200 was built to evaluate the effect of near field plates as depicted in FIGS. 2A and 2B. Near field plates 116 such as those depicted in FIGS. 2A and 2B were built (Sample 1), as well as control plates comprising a metallic ductile cast iron base substrate having a thickness as the near field plates 116 but without the electrically conductive loops 34*a*-34*d* (Sample 2). The results of the near field plates 116 and control substrates were then compared, as described below.

The experimental test apparatus 200 was based on a linear actuator designed to evaluate the effect of each sample on the magnetic force generated by the system. The experimental test apparatus 200 generally comprises an electromagnet actuator 210 having a magnet body 212 similar to that illustrated in FIG. 1 that was rigidly coupled to a test table 258. The magnet body 212 had a protruding portion 222 and first and second coils 214, 220, as described above. The first and second coils 214, 220 were configured as two series-connected 40-turn coils made of 16 AWG Cu magnet wire. A near field plate 216 was coupled to a tip of the protruding portion 222. The first and second coils 214, 220 were coupled to a 20 V, 1 KHz alternating current (AC) power supply via power cable 256. A plunger 218 was maintained using an air bearing (not shown) coupled to an air supply 252. The magnet body 212 and plunger 218 were each fabricated of 80 layers of 0.353 mm thick M15 grade C5 fully annealed electrical steel. The plunger 218 traveled in a linear fashion on the frictionless 60 psi air bearing. The plunger 218 was coupled to a precision, high stiffness load cell 254 coupled to a digital readout 250 for measurement of the magnetic force generated by the actuator.

For the design of the near field plates, system and corresponding theoretical studies, a normally incident kHz magnetic field was assumed. Thus, the governing wave equation for the near field plate is given by:

$$(\nabla^2+k^2)\vec{H}=-\nabla\times\vec{J}, \tag{1}$$

In Equation (1), $\vec{H}$ is the magnetic field, $\vec{J}$ is the induced current density, and k is the wave number. The incoming magnetic field provided by the magnetic body induces a current in the loop structure of the electrically conductive loops. A corresponding analytical model is assumed to be composed of multiple loop structures located in the x-y plane at z=0 with a focal plane at z=d (see FIG. 2B). The incident and transmitted fields, $\vec{H}_{in}(x, y, z)$ and $\vec{H}_{trans}(x, y, z)$, respectively, both propagate in the positive z-direction. The resultant magnetic field may then be calculated by integrating the free space Green's function multiplied by the curl of the induced current density:

$$\begin{aligned}\vec{H}(x, y, z) &= \int (x, y, z, x', y', z'=0)\nabla\times\vec{J}(x', y')\,dx'dy' \\ &= 1/4\pi\int\left\{\frac{1}{\left((x-x')^2+(y-y')^2+z^2\right)^{\frac{1}{2}}}\right\}\nabla\times\vec{J}(x'y')\,dx'dy'\end{aligned} \tag{2}$$

The boundary condition at z=0 satisfies the following equation, $$\begin{aligned}\vec{H}_{trans}(x, y, z=0) &= \vec{H}_{in}(x, y, z=0) - \\ &1/4\pi\int_{-D/2}^{D/2}\int_{-L/2}^{L/2}\left\{\frac{1}{\left((x-x')^2+(y-y')^2+z^2\right)^{\frac{1}{2}}}\right\}\nabla\times\vec{J}(x'y')\,dx'\,dy',\end{aligned} \tag{3}$$

where, in this case, the curl of the current density is calculated for a desired field pattern, which is later used to calculate the field distribution at the focal plane via Equation (2).

Figure 5A:
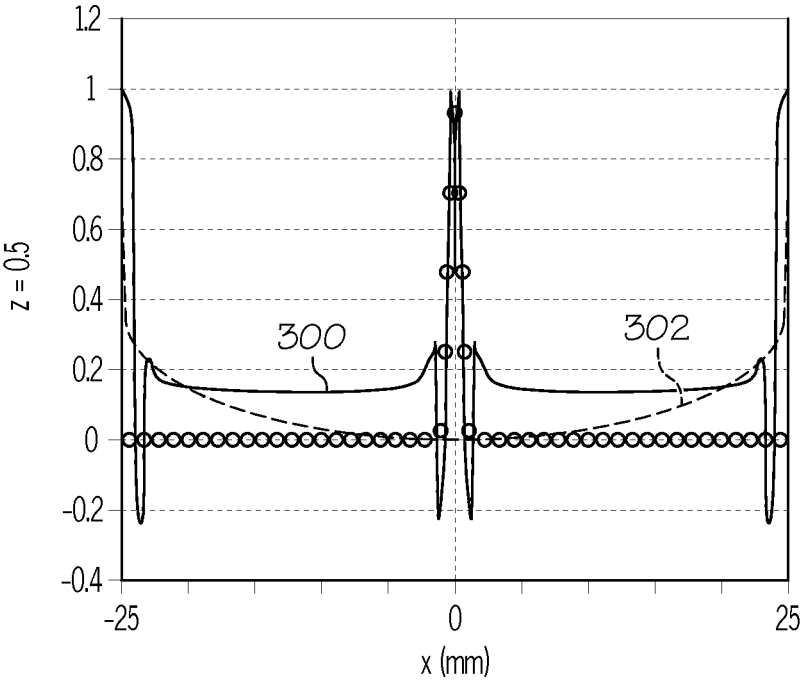
FIG. 5A is a graph that depicts the analytically calculated normalized magnetic field norm for Sample 1, and computed numerical results for Samples 1 and 2.

The normalized magnetic field norm, $\|\vec{H}\|$, was calculated analytically for Sample 1 (i.e., near field plate 116 fabricated as described above) under an incident field of 1 A/m in the +z direction using Equations (1)-(3). The analytical results are shown in FIG. 5A, where the abscissa runs from x=−25 mm to x=25 mm along a cut line positioned at y=7.5 mm and z=0.05 mm. The analytical calculation assumed 51 sampling current loops centered at y=7.5 mm for a total combined loop length of L=50 mm. Curve 300 represents numerical results for Sample 1 (i.e., with conductive loops), curve 302 represents numerical results for Sample 2 (i.e., without conductive loops), and curve 304 represents analytical results for Sample 1.

Electromagnetic numerical simulations were performed using finite element method based simulations in COMSOL Multiphysics v.4.2a. Samples 1 and 2 were compared using a three-dimensional one-fourth symmetry model of the actuator with an applied 1 kHz AC signal for the external coil of the system. In each model, the y-direction normalized magnetic field norm at z=0.05 mm and normalized current density at z=0 for a 0.05 mm air gap between the plunger and sample was investigated.

Figure 5B:
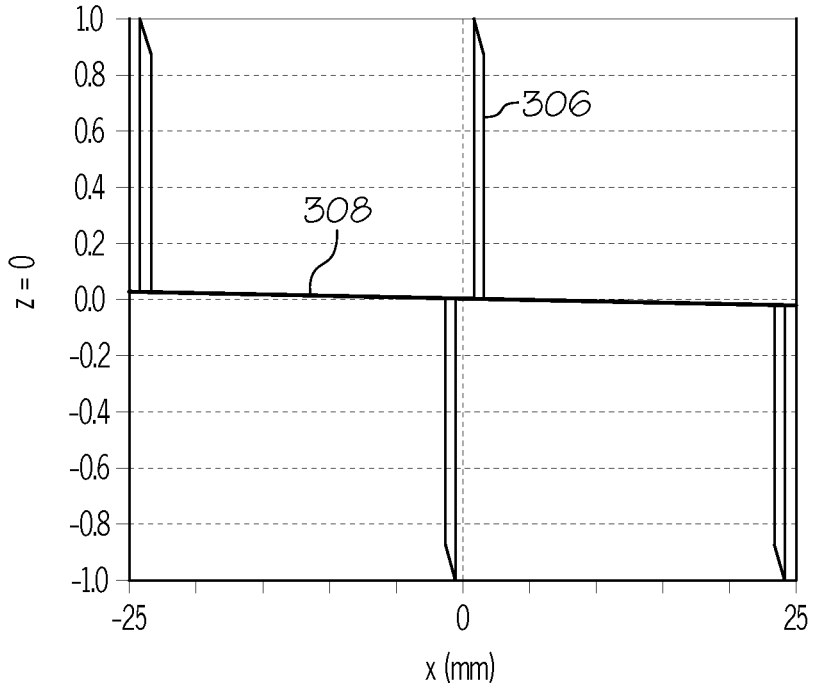
FIG. 5B is a graph that depicts the computed and measured magnetic force ratios for the magnetic actuator of the experimental test apparatus depicted in FIG. 4 with Sample 1 relative to Sample 2.

The numerical results for the normalized magnetic field norm and current density are, respectively, plotted in FIGS. 5A and 5B. FIG. 5A depicts the analytically calculated normalized magnetic field norm for Sample 1 plus computed numerical results for Samples 1 and 2 at z=0.05 mm along a cut line positioned at y−7.5 mm and running from x=−25 mm to x=25 mm. The numerical results are normalized by the maximum magnetic field norm value for Sample 1.

FIG. 5B depicts the computed normalized y-direction current density numerical results for Samples 1 and 2 at z=0 along a cut line positioned at y=7.5 mm and running from x=−25 to x=25 mm (see the dashed line between points 'a' and 'b' in FIG. 2B). The numerical results are normalized by the maximum current density value for Sample 1. Curve 306 represents the numerical results for Sample 1 and curve 308 represents the numerical results for Sample 2.

The numerical results for Sample 1 in FIG. 5B depict an induced current in the electrically conductive loops of the near field plate. Specifically, the real part of the simulated current density, $J_y$, in the metallic loops generally decreases with increasing x except for the crossing at x=0 (at the central gap) because anti-clockwise currents are induced in the two loop structures. Consequently, the spatial variation of $\nabla\times\vec{J}$ is nearly zero everywhere except at the center and edges of the device. These peaks in $\nabla\times\vec{J}$ lead to a substantially focused magnetic field at x=0 according to Equation (1), while the focused field around the periphery of the electrically conductive loops is due to the fact that the magnetic field is also present outside the near field plate in the simulation domain. The near field plate 116 depicted in FIGS. 2A and 2B has a spot of 1.2 mm FWHM (Full Width Half Maximum) at z=0.05 mm, as shown in the analytical and numerical results in FIG. 5A. The magnetic field is focused on a spot of $0.4\times10^{-8}\lambda_0$ FWHM, where $\lambda_0$ is a free space wavelength of $3\times10^5$ m. In contrast, the computed results for control Sample 2 in FIG. 5A show that the magnetic field exhibits a rise only towards the edges of the iron substrate due to the presence of relatively small magnitude eddy currents (see FIG. 5B). For Sample 1, the effect of the magnetic field focusing on the magnetic force, F, acting on the plunger may be understood in the context of a Maxwell's stress tensor analysis:

$$F=\left[\oint\frac{1}{2\mu}(B_n^2-B_t^2)ds\right]n+\left[\oint\frac{1}{\mu}B_n\cdot B_t ds\right]t, \tag{4}$$

where B is the magnetic flux density, and n plus t are, respectively, unit vectors normal and tangential to the integration path, s, enveloping the body subject to the magnetic force. An increase in magnetic force due to a focused field distribution may be explained theoretically using Equation (4). Here, the force acting on the plunger is calculated by integrating the second order terms in both the normal and tangential directions. The normal direction magnetic force term, $F_n$, may be maximized for a constant magnetic flux, $\Phi=\int\sqrt{B_n^2+B_t^2}\,d(\text{Area})$, by focusing the distribution of $B_n$ with zero $B_t$ everywhere. Thus, due to the squared terms in the magnetic flux expression, the plunger force resulting from a focused distribution is significantly higher than that produced by an even distribution.

To validate the above analysis, magnetic force measurements were made using the previously-described experimental test apparatus 200 in conjunction with Samples 1 and 2. For the experiments, the air gap between the plunger and each sample was set to fixed values ranging from 0.05 mm to 0.45 mm in 0.1 mm increments via a micrometer adjustment feature built into the test apparatus. Thus, the magnetic force generated by the system with each sample installed was measured as a function of the linear actuator air gap for a fixed voltage applied to the electromagnetic system.

Figure 6A:
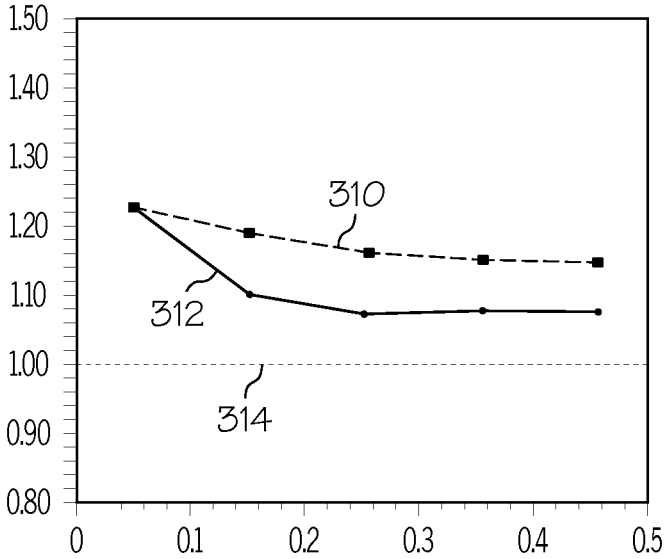
FIG. 6A is a graph that depicts the computed and measured magnetic force ratios for the magnetic actuator of the experimental test apparatus depicted in FIG. 4 between Sample 1 relative to Sample 2 plotted as a function of air gap.

The force ratio for Sample 1 relative to the control Sample 2 (i.e., $F_{S1}/F_{S2}$) was calculated and plotted as a function of the air gap and is shown in FIG. 6A. Dashed curve 310 represents the numerically computed ratio of $F_{S1}/F_{S2}$, curve 312 represents the experimentally obtained ratio $F_{S1}/F_{S2}$ The horizontal dashed line 314 in this figure represents experimental control Sample 2 (i.e., $F_{S1}/F_{S2}$). Sample 1 demonstrates a force enhancement of 23% at the smallest measured air gap of 0.05 mm. At air gaps greater than 0.15 mm, Sample 1 continues to display an almost 10% enhancement in the generated magnetic force. Regarding the numerically computed force ratio for Sample 1 relative to Sample 2, the magnitude of the computed force enhancement is within 10% of the measured value for all air gaps. Remaining errors are due to uncertainties in material physical parameters plus external losses not captured by the simulations. For example, the numerical models did not account for eddy-current and hysteresis losses in terms of the associated energy dissipation in the form of heat. Nevertheless, the magnetic force enhancement trend is verified as an expected outcome of the magnetic field focusing.

Figure 6B:
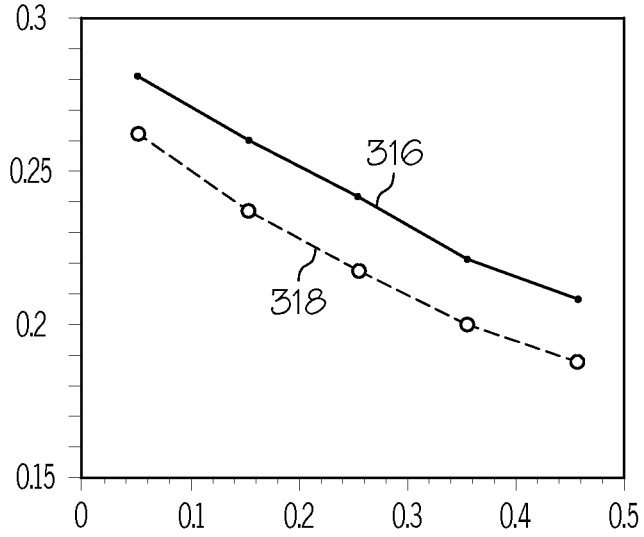
FIG. 6B is a graph that depicts the measured Power Factor of the magnetic actuator of the experimental test apparatus depicted in FIG. 4 as a function of air gap.

The experimental force ratio results shown in FIG. 6A are based on a constant input voltage which represents the enhanced performance of a typical voltage-controlled electromechanical device; however the input power varies from one experimental result to another. Thus, Power Factor (PF), a simple ratio of real to apparent power, may be used to indicate the efficiency enhancement based on a constant input power. Here, the real power represents the energy required to produce mechanical strain in the load cell and is therefore related to the measured actuator force. FIG. 6B provides the measured PF of the actuator with Samples 1 and 2 installed, curves 316 and 318, respectively, where a PF value of unity is the best possible. The system with Sample 1 has a 10% higher average PF when compared with the system with Sample 2, thereby indicating a more efficient electromechanical device due to magnetic field focusing provided by the near field plate.

Figure 7:
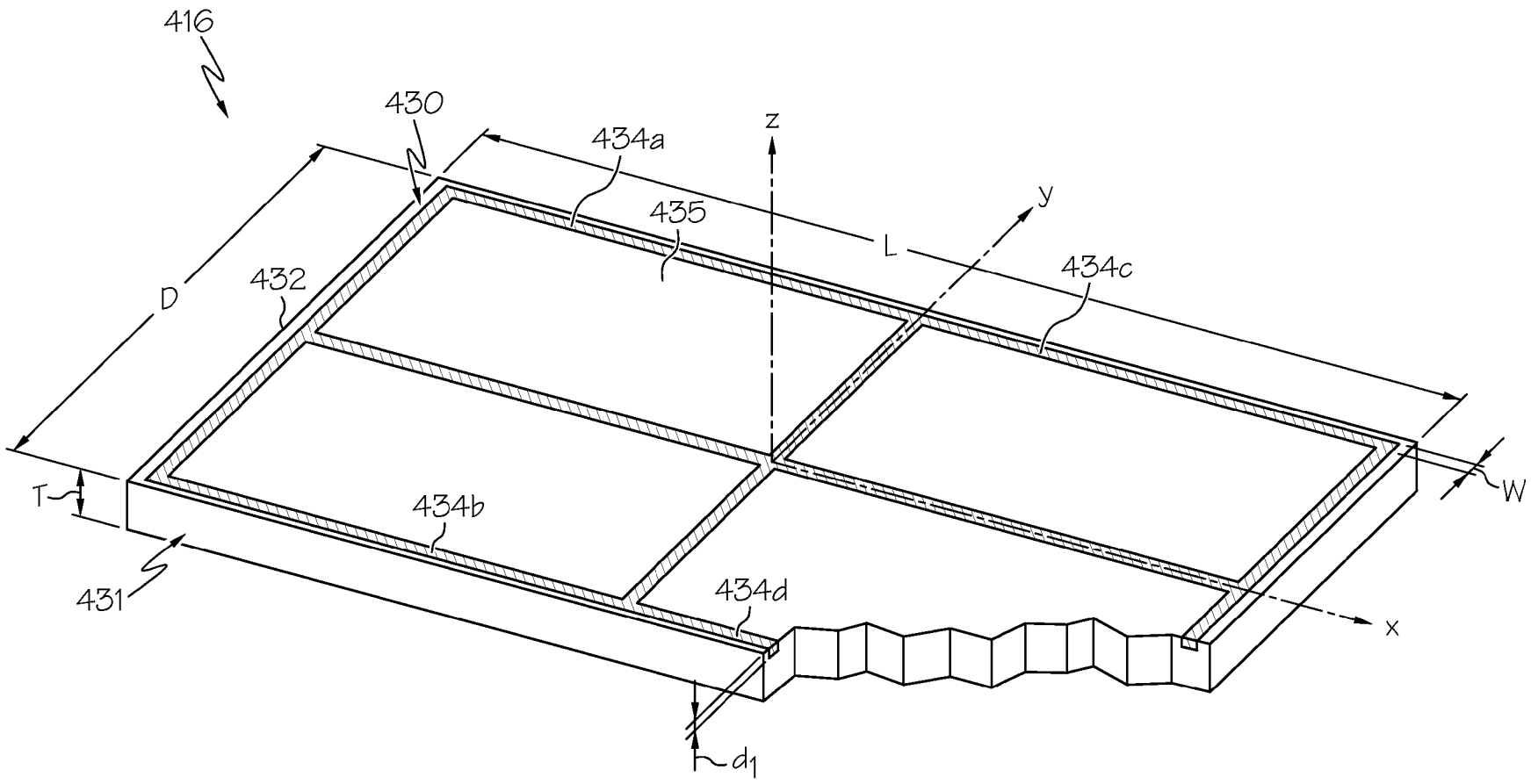
FIG. 7 schematically depicts an exemplary near field plate for magnetic field shielding according to one or more embodiments shown and described herein.

As stated above, rather than providing a magnetic field focusing effect, the near field plates described herein may be configured to provide a magnetic field shielding effect, wherein the lines of magnetic flux passing through the near field plate diverge rather than converge. Referring now to FIG. 7, an exemplary magnetic field manipulation device configured as a near field plate 416 that defocuses a magnetic field is schematically illustrated. The near field plate 416 comprises a base substrate 431 having a surface 435. The base substrate 431 may comprise a ferromagnetic material having low electric conductivity, such as iron, for example. Electrically conductive loops 434*a*-434*d* are embedded within the surface 435 of the base substrate 431. The electrically conductive loops 434*a*-434*d* may be of a highly conductive material, such as copper. Unlike the near field plate 16 depicted in FIGS. 2A and 2B in the magnetic field focusing embodiment, the electrically conductive loops 434*a*-434*d* of the near field plate 416 depicted in FIG. 7 are electrically coupled to one another by sharing borders. There are no dielectric gaps located between the electrically conductive loops 434*a*-434*d* in the present embodiment. It should be understood that more than four electrically conductive loops may be provided, and in shapes other than rectangles. The electrically conductive loops 434*a*-434*d* may be fabricated as described above with respect to the near field plate 16 depicted in FIGS. 2A and 2B, and also have similar (or different) dimensions. In one embodiment, the base substrate is a 50 mm×30 mm×2.5 mm (L×D×T) metallic ductile cast iron substrate, and the electrically conductive loops 434*a*-434*d* have a width w of about 0.8 mm and a depth $d_l$ of about 0.5 mm.

Figure 8:
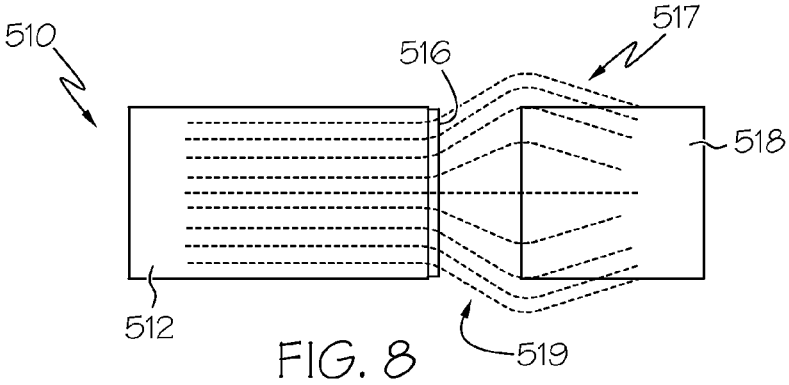
FIG. 8 schematically depicts an exemplary magnetic actuator having a near field plate providing a defocused magnetic field according to one or more embodiments shown and described herein.

The electrically coupled loops 434*a*-434*d* manipulate the magnetic field passing through the near field plate 416 such that the lines of magnetic flux are defocused at a location proximate the near field plate 416. FIG. 8 depicts a simplified electromagnetic actuator 510 having a magnet body 512, a near field plate 516, and a plunger 518. The near field plate 516 is coupled to an end face of the magnet body 512, and is configured as the shielding near field plate 516 illustrated in FIG. 7. The magnet body 512, which may be configured as an electromagnet having a coil (not shown in FIG. 8), produces a magnetic flux as depicted by dotted magnetic flux lines 517.

The near field plate 516 defocuses the magnetic lines of flux 517 from the magnet body 512 so that they substantially travel away from a central portion of the plunger 518 in an air gap 519. In other words, the magnetic lines of flux 517 diverge at the plunger 518. Defocusing of the magnetic field occurs through the air gap 519 between the near field plate 516 and the plunger 518. In such a manner, the near field plate 516 shields the plunger 518 from a majority of the magnetic field.

The shielding effects of the near field plate 516 were substantiated by performing experiments utilizing the experimental test apparatus 200 depicted in FIG. 4. Several focusing near field plates in accordance with the near field plate 16 depicted in FIGS. 2A and 2B and several shielding near field plates in accordance with the near field plate 516 depicted in FIG. 7 were fabricated as described above and tested using the experimental test apparatus 200. Additionally, a baseline plate (i.e., control) was fabricated. The baseline plate comprised a base substrate similar to the focusing and shielding near field plates 16/516 (same material and dimensions) but without the electrically conductive loops. The force detected by the load cell 254 was recorded for the focusing near field plate 16, the shielding near field plate 516, and the baseline plate at various air gaps between the near field plate 16/516 and the plunger 218.

Figure 9:
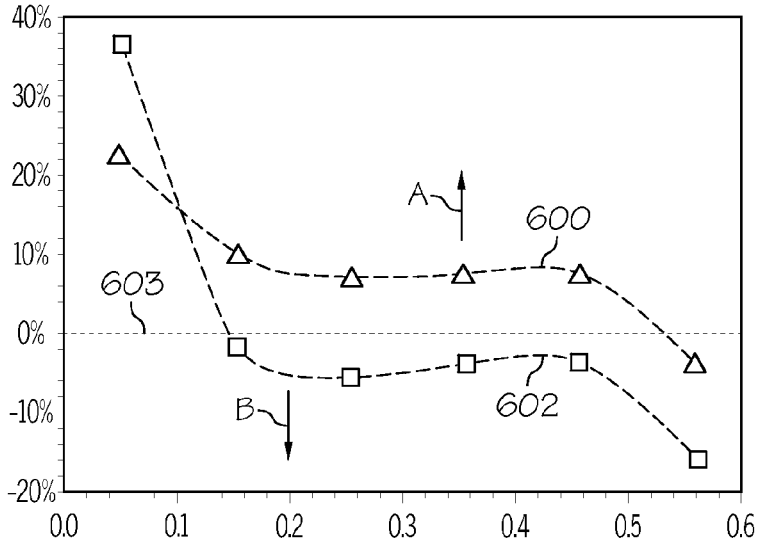
FIG. 9 is a graph that plots the change in magnetic force provided by a focusing near field plate and a shielding near field plate compared to a baseline plate using the magnetic actuator of the experimental test apparatus depicted in FIG. 4.

FIG. 9 is a graph depicting the change in magnetic force (%) of the focusing near field plate 16 (focused magnetic force, curve 600) and the shielding near field plate 516 (shielded magnetic force, curve 603) as compared to the baseline plate (non-focused/non-shielded magnetic force depicted by dashed line 603). Change in force above dashed line 603 as indicated by arrow A indicate magnetic field focusing on the plunger 218, while change in force below dashed line 603 as indicted by arrow B indicate magnetic field shielding. As shown in FIG. 9, both the focusing and shielding near field plates 16, 516 provided magnetic field focusing on the plunger 218 at an air gap of less than about 0.15 mm; however, the shielding near field plate 516 provided magnetic field shielding at an air gap between about 0.15 mm and about 0.475 mm with a reduced force of approximately 5% compared to the baseline plate. The focusing near field plate 16 continued to provide an increased force on the plunger 218 up to an air gap of about 0.525 mm, with an approximately 10% increase in force at an air gap distance between about 0.15 mm and about 0.475 mm. Accordingly, the shielding near field plates 516 described herein may be used in magnetic shielding applications wherein the magnetic field receiving component (e.g., a plunger) is separated from the shielding near field plate 516 at an appropriate air gap distance. In some applications, the shielding near field plate 516 may be utilized to increase the magnetic force on a magnetic field receiving component when the air gap is small.

Figure 10:
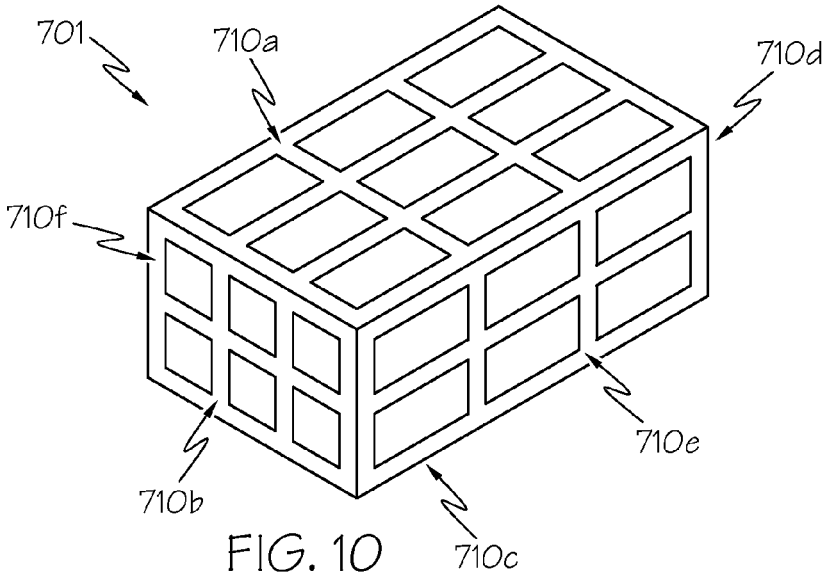
FIG. 10 schematically depicts an electronic component that is covered with six near field plates configured to defocus lines of magnetic flux according to one or more embodiments shown and described herein.

Embodiments of the shielding near field plate 516 may be used in EMI shielding applications to protect components or circuits that are close to a magnetic field source. FIG. 10 depicts an electronic component 701 that is covered with six near field plates 710*a*-710*f* configured to defocus lines of magnetic flux. The electronic component 701 may be any device that generates a magnetic field, such as a switching inverter circuit for an electric or hybrid vehicle, for example. In the illustrated embodiment, near field plates 710*a* and 710*c* have nine electrically conductive loops, while the remaining near field plates 710*b*, 710*d*-710*f* have six electrically conductive loops. It should be understood that more or fewer near field plates may be utilized, and more or fewer electrically conductive loops may be provided.

The near field plates 710*a*-710*f* are configured to defocus the magnetic field in an air gap between the electronic component 701 and any magnetic field receiving component (e.g., a circuit, an integrated circuit, microcontroller, and the like) that may be located close the electronic component 701. In this manner, the near field plates 710*a*-710*f* may shield the magnetic field receiving components from at least a portion of the magnetic field generated by the electronic component 701.

It should now be understood that embodiments described herein may be configured to focus or defocus magnetic fields generated by a magnetic field generating device in magnetic field focusing or shielding applications. In some embodiments, a magnetic field manipulation device may be utilized in a magnetic actuator application to focus magnetic lines of flux generated by a magnet toward an actuated portion, such as a plunger. The magnetic field manipulation device may be configured as a near field plate having an array of electrically isolated, electrically conductive loops.

In other embodiments, the magnetic field manipulation device may be utilized in magnetic field shielding applications to defocus magnetic lines of flux around a component located close to a magnetic field generating component. The magnetic field manipulation device may be configured as a near field plate having an array of electrically coupled, electrically conductive loops.

It is noted that terms such as "substantially," "approximately," and "about" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A magnetic field manipulation device comprising:

an iron substrate comprising a surface and an array of segments comprising at least four segments;

at least four electrically conductive non-concentric loops embedded in the surface of the iron substrate, wherein an individual electrically conductive non-concentric loop is embedded in an individual segment, and wherein individual segments of the array of segments are coupled together by a dielectric bonding agent such that the individual electrically conductive non-concentric loop of each segment is electrically isolated from electrically conductive non-concentric loops of adjacent segments in the array of segments; and the at least four electrically conductive non-concentric loops are arranged in the surface of the iron substrate such that the magnetic field manipulation device converges magnetic flux lines of a magnetic field generated by a magnetic field source positioned proximate the magnetic field manipulation device.

2. The magnetic field manipulation device of claim 1, wherein the magnetic field manipulation device converges the magnetic flux lines such that a magnetic field receiving component positioned proximate the magnetic field source receives a focused magnetic force that is greater than a non-focused magnetic force received by the magnetic field receiving component in an absence of the magnetic field manipulation device.

3. The magnetic field manipulation device of claim 1, further comprising grooves within the surface of the iron substrate of each segment, wherein the individual electrically conductive non-concentric loop of each segment is located within the grooves.

4. The magnetic field manipulation device of claim 1, wherein the electrically conductive non-concentric loops are rectangular in shape.

5. The magnetic field manipulation device of claim 1, wherein each individual electrically conductive non-concentric loop has a width of about 0.8 mm.

6. The magnetic field manipulation device of claim 1, wherein each individual electrically conductive non-concentric loop has a depth of about 0.5 mm.

7. A magnetic field manipulation device comprising:

an iron substrate comprising a surface and an array of segments comprising at least four segments;

at least four electrically conductive non-concentric loops embedded in the surface of the iron substrate, wherein an individual electrically conductive non-concentric loop is embedded in an individual segment, and wherein the at least four electrically conductive non-concentric loops are electrically coupled to one another; and the at least four electrically conductive non-concentric loops are arranged in the surface of the iron substrate such that the magnetic field manipulation device diverges magnetic flux lines of a magnetic field generated by a magnetic field source positioned proximate the magnetic field manipulation device.

8. The magnetic field manipulation device of claim 7, wherein the magnetic field manipulation device diverges magnetic flux lines such that a magnetic field receiving component positioned proximate the magnetic field source receives a shielded magnetic force that is less than a non-shielded magnetic force received by the magnetic field receiving component in an absence of the magnetic field manipulation device.

9. The magnetic field manipulation device of claim 7, further comprising grooves within the surface of the iron substrate of each segment, wherein at least four electrically conductive non-concentric loops are located within the grooves.

10. The magnetic field manipulation device of claim 7, wherein the at least four electrically conductive non-concentric loops are rectangular in shape.

11. The magnetic field manipulation device of claim 7, wherein the at least four electrically conductive non-concentric loops have a width of about 0.8 mm.

12. The magnetic field manipulation device of claim 7, wherein each individual electrically conductive non-concentric loop has a depth of about 0.5 mm.

* * * * *